US006241016B1

(12) United States Patent
Dedels

(10) Patent No.: US 6,241,016 B1
(45) Date of Patent: Jun. 5, 2001

(54) DRIVE HEAD ASSEMBLY

(75) Inventor: Rick Dedels, Edmonton (CA)

(73) Assignee: R & M Energy Systems, Houston, TX (US)

( * ) Notice: Subject to any disclaimer, the term of this patent is extended or adjusted under 35 U.S.C. 154(b) by 0 days.

(21) Appl. No.: 09/285,343

(22) Filed: Apr. 2, 1999

Related U.S. Application Data

(60) Provisional application No. 60/080,552, filed on Apr. 3, 1998.

(51) Int. Cl.[7] ..... F04B 23/02

(52) U.S. Cl. ..... 166/68.5; 166/104; 166/105; 417/441; 418/206.1

(58) Field of Search ..... 417/297, 441; 418/206.1, 205; 166/68.5, 72, 78.1, 104, 105

(56) References Cited

U.S. PATENT DOCUMENTS

| | | | |
|---|---|---|---|
| 523,506 | 7/1894 | Barnes . | |
| 2,094,416 | 9/1937 | Sheffield | 285/146 |
| 2,208,074 | 7/1940 | Holz | 188/90 |

(List continued on next page.)

FOREIGN PATENT DOCUMENTS

| | | |
|---|---|---|
| 1153307 | 9/1983 | (CA) . |
| 2098324 | 6/1993 | (CA) . |
| 3907053 | 9/1990 | (DE) . |
| 2210931 | 10/1988 | (GB) . |
| WO8807126 | 9/1988 | (WO) . |
| WO9710437 | 3/1997 | (WO) . |

OTHER PUBLICATIONS

GrenCo Industries Ltd. Product Literature, *Operating Instructions for Wellhead Drive Unit for PC Pump* Model: G–2000, May 2, 1996.

Highland/Corod, Inc. Product Literature, *Progressive Cavity Pumping Systems*. (undated).

CADE/CAODC Spring Drilling Conference Literature, Apr. 19–21, 1995.

*Primary Examiner*—David Bagnell
*Assistant Examiner*—Zakiya Walker
(74) *Attorney, Agent, or Firm*—Thompson Hine & Flory LLP

(57) ABSTRACT

The present invention provides a pump drive assembly for a deep well, submersible, progressing cavity pump that includes an internal hydraulic pump for slowing the counter rotation of the polished rod induced by recoil in the sucker rod. The pump drive assembly includes a housing enclosing a hydraulic fluid reservoir and a gear chamber separate from the reservoir. A drive shaft extends into the housing and includes a drive gear integral with or keyed to the drive shaft. A main shaft also extends into the housing and includes a main gear integral with or keyed to the main shaft. The main gear is engaged with the drive gear within the gear chamber, where the gear chamber includes an inlet and an outlet channel providing fluid communication between the gear chamber and the reservoir, so that the gears form a reversible gear pump within the housing. The reversible gear pump operates to pump hydraulic fluid from the reservoir into the gear chamber and back into the reservoir. During normal operation of the drive assembly, the gear pump will operate in the forward direction; but when the polished rod is caused to recoil, the gear pump will be caused to operate in the reverse direction. Therefore, the pump drive assembly also includes a flow resistor coupled to at least one of the inlet and outlet channels for retarding the flow of the hydraulic fluid when the gear pump is operating in the reverse direction, thus slowing counter-rotation of the polished rod during recoil.

20 Claims, 4 Drawing Sheets

U.S. PATENT DOCUMENTS

| | | | | |
|---|---|---|---|---|
| 2,688,385 | | 9/1954 | McLaughlin et al. | 188/90 |
| 2,919,682 | | 1/1960 | Sung | 121/70 |
| 3,881,849 | | 5/1975 | Commarmot et al. | 418/182 |
| 3,960,459 | | 6/1976 | Hering et al. | 403/267 |
| 4,205,926 | | 6/1980 | Carlson | 403/266 |
| 4,372,379 | | 2/1983 | Kulhanek et al. | 166/68.5 |
| 4,400,147 | * | 8/1983 | Springer et al. | 418/206 |
| 4,714,110 | | 12/1987 | Dysarz | 166/68 |
| 4,797,075 | | 1/1989 | Edwards et al. | 418/48 |
| 4,850,736 | | 7/1989 | Petrie | 403/344 |
| 4,887,929 | | 12/1989 | Hale | 403/328 |
| 5,088,905 | | 2/1992 | Beagie | 418/55 |
| 5,327,961 | * | 7/1994 | Mills | 166/68.5 |
| 5,333,963 | | 8/1994 | Blumentrath | 403/301 |
| 5,358,036 | | 10/1994 | Mills | 166/68.5 |
| 5,370,179 | | 12/1994 | Mills | 166/68.5 |
| 5,551,510 | | 9/1996 | Mills | 166/68 |
| 5,567,138 | | 10/1996 | Newton | 418/48 |

* cited by examiner

DRIVE HEAD ASSEMBLY

CROSS REFERENCE TO RELATED APPLICATIONS

The present application claims benefit under 35 U.S.C. §119 from Provisional Patent Application Ser. No. 60/080,552, filed Apr. 3, 1998.

BACKGROUND

The present invention is directed to a drive head assembly for a deep well, submersible, progressing cavity pump; and more particularly, to an assembly for slowing the counter rotation of the polished rod induced by recoil in the sucker rod, and further, to a clamp adapted to coaxially secure the polished rod to a main shaft of the drive head assembly in a manner that allows some relative vertical movement of the sucker rod and associated polished rod without the polished rod becoming disengaged from the main shaft.

Progressing cavity pumps (and other types of rotary pumps) are conventionally used as down-hole pumps in the oil production industry. The helical rotors of such progressing cavity pumps are driven by a rod string or sucker rod coaxially coupled to a polished rod, which is in turn driven by a drive assembly typically located above the surface. The drive assembly, powered by a motor, is adapted to rotatably drive the polished rod and associated sucker rod. Typically, the sucker rod is a metallic rod a few inches in diameter and thousands of feet in length, and is coaxially coupled between the polished rod and the helical rotor of the progressing cavity pump. Because a substantial torsional force is often required to start the helical rotor turning within the progressing cavity pump stator, the drive assembly will turn or twist the sucker rod many times (conventionally in the range of 40 to 50 times) before the rotor begins to turn within the stator. Torsional force used to twist the sucker rod the 40 or 50 times is stored in the elongated sucker rod until the motor is disengaged or shut off. Once the motor is disengaged or shut off, this stored energy (the extra twists in the sucker rod) will immediately begin to be released in the form of a rapid recoil of the sucker rod. Unless this recoil is controlled or slowed, the motor and associated drive belts can become damaged by the rapid counter rotation of the polished rod.

Known ways for controlling such recoil include a disc brake mechanism to slow the counter rotation of the polished rod, or an external hydraulic pump mechanism coupled to the drive assembly. However, these prior art methods have several known disadvantages. With a disc brake mechanism, a great deal of friction is created during recoil releasing a large amount of heat. This causes unnecessary wear on the machinery, often requiring replacement of parts which results in production delays. External hydraulic pump mechanisms, while being more reliable than disc brakes, have their own attendant problems. An external pump contains more parts and is more complex in structure than one that is integral to the drive head assembly. Thus, an external pump is more liable to failure and more expensive to fabricate than a pump that is integral with the drive head assembly.

Also, as a result of this torsional displacement the sucker rod has a tendency to get longer at either end in much the same way a rubber band does when it is twisted longitudinally. Prior art clamps have not been effective in accommodating this longitudinal movement of the sucker rod/polished rod assembly caused by these torsional forces thus causing decreased pump efficiency. Also, the static clamping mechanisms of prior art inventions do not provide an easy method for lifting the rotor from the stator in order to backwash the hole of sand and grit.

Accordingly, there exists a need for a device for controlling polished rod recoil that contains few moving parts, is of fairly simple construction, is integral with the drive head, and is not prone to failure. There is also a need for a clamp for securing a polished rod and associated sucker rod to a main shaft of a pump drive-head assembly in a manner that allows for some longitudinal freedom of movement, so as to account for longitudinal expansion from torsional forces on the sucker rod, and so as to also provide an easy method for backwashing the hole.

SUMMARY

The present invention provides a pump drive assembly that includes an internal hydraulic pump for slowing the counter rotation of the polished rod induced by recoil in the sucker rod. The pump drive assembly includes a housing enclosing a hydraulic fluid reservoir and a separate gear chamber therein. A drive shaft, coupled to a motor by associated motor belts and/or gears, extends into the housing and includes a drive pinion integral with or keyed thereto. This drive pinion is positioned within gear chamber. A main shaft assembly also extends into the housing and includes a main gear integral with or keyed thereto, where the main gear is also positioned in the gear chamber and engaged with the drive pinion therein. The polished rod is coaxially coupled to the main shaft assembly by a polished rod clamp. When the polished rod is coupled to the main shaft assembly, positive rotation of the drive shaft causes an opposite (forward) rotation of the polished rod and associated sucker rod.

The gear chamber includes an inlet and outlet channel providing fluid communication between the chamber and the reservoir so as to form a reversible, hydraulic gear pump within the drive assembly. Operation of the drive assembly in a forward direction causes the gear pump to pump hydraulic fluid in a forward direction, from the reservoir, through the inlet channel, into the gear chamber, and out through the outlet channel, back into the reservoir; and operation of the drive assembly in a reverse direction, causes the gear pump to pump hydraulic fluid in a reverse direction, in through the outlet channel, into the gear chamber, and out through the inlet channel back into the reservoir. Recoil of the sucker rod and associated polished rod will cause counter-rotation of the polished rod, and in turn, reverse operation of the gear pump. Accordingly, to control the speed of counter-rotation of the polished rod, a flow resistor, such as a modified check valve is positioned in the inlet or outlet channel so as to substantially retard or slow the reverse flow of hydraulic fluids therethrough. Preferably, this modified check valve also allows for substantially full throughput of hydraulic fluids passing therethrough when the gear pump operates in the forward direction. Accordingly, the internal hydraulic gear pump of the drive head assembly is used to control and slow the recoil in the sucker rod. Furthermore, because the hydraulic gear pump is integral with the pump drive assembly; no external hydraulic hoses and related components are necessary.

The polished rod clamp, used to coaxially couple the polished rod to the main shaft comprises a pair of semi-cylindrical components which attach to each other to form a collar that encases the polished rod. Each of the semi-cylindrical clamp components includes an axially extending arcuate channel, each of which is adapted to receive a corresponding arcuate arm extending axially from the main shaft assembly. The arcuate arms of the main shaft assembly are substantially longer than the arcuate channels of the polished rod clamp and, therefore, allow the polished rod clamp to slide up and down the main shaft assembly (a few inches in the preferred embodiment) without becoming disengaged from the main shaft assembly. This cures a recognized problem of the polished rod clamp disengaging from the polished rod due to the above mentioned expansion of the sucker rod due to torsional forces. Also, the polished rod clamp of the present invention helps prevent disengagement due to slight disturbances (bouncing) in the polished rod and sucker rod.

Accordingly it is an object of the present invention to provide a pump drive assembly for a deep well progressing cavity pump that includes a reversible, hydraulic gear pump integrated therein, where the hydraulic fluid pumps hydraulic fluid in a forward direction when the polished rod is rotating in a forward direction and pumps hydraulic fluid in a reverse direction when the polished rod is rotating in a reverse direction, and where the hydraulic gear pump includes a flow resistor for substantially retarding flow of hydraulic fluid when operating in the reverse direction.

It is a further object of the present invention to provide a pump drive assembly that comprises a housing enclosing a hydraulic fluid reservoir and a separate gear chamber, a drive shaft assembly including a drive shaft and a drive gear integral with or keyed to the drive shaft, and a main shaft assembly including a main shaft and a main gear integral with or keyed to the main shaft. The main gear is engaged with the drive gear within the gear chamber, and the gear chamber includes an inlet and an outlet channel providing fluid communication between the gear chamber and the reservoir, so that the gears form a reversible gear pump within the housing. The reversible gear pump operates to pump hydraulic fluid from the reservoir into the chamber and back into the reservoir. The reversible gear pump operates in a forward direction when the main shaft is rotating in a forward direction and operates in a reverse direction when the main shaft is rotating in a reverse direction, i.e., during recoil. The pump drive assembly also comprises a flow resistor coupled to at least one of the inlet and outlet channels for impeding the flow of the hydraulic fluid when the gear pump is operating in the reverse direction, thus controlling the speed of the polished rod's counter-rotation during recoil. Also, this flow resistor preferably, but not necessarily, permits substantially free flow of the hydraulic fluid therethrough when the gear pump is operating in the forward direction.

It is a further object of the present invention to provide a coupling assembly for coaxially coupling a polished rod of a deep well progressing cavity pump to a main shaft of a pump drive assembly that comprises a plurality of axially extending arms extending from one of the polished rod and the main shaft, and a collar extending radially from the other one of the polished rod and the main shaft, where the collar includes a corresponding plurality of axially extending channels slidably receiving the axially extending arms.

It is a further object of the present invention to provide a coupling assembly for coaxially coupling a polished rod of a deep well progressing cavity pump to a main shaft of a drive assembly that comprises at least two coupling components capable of being joined together to securely encase a longitudinal portion of the polished rod, where the coupling components collectively contain at least two channels extending axially therethrough so as to slidingly receive corresponding arms extending axially from the main shaft.

Other objects and advantages of the present invention will be apparent from the following description, the accompanying drawings and the appended claims.

DETAILED DESCRIPTION

Figure 1A:
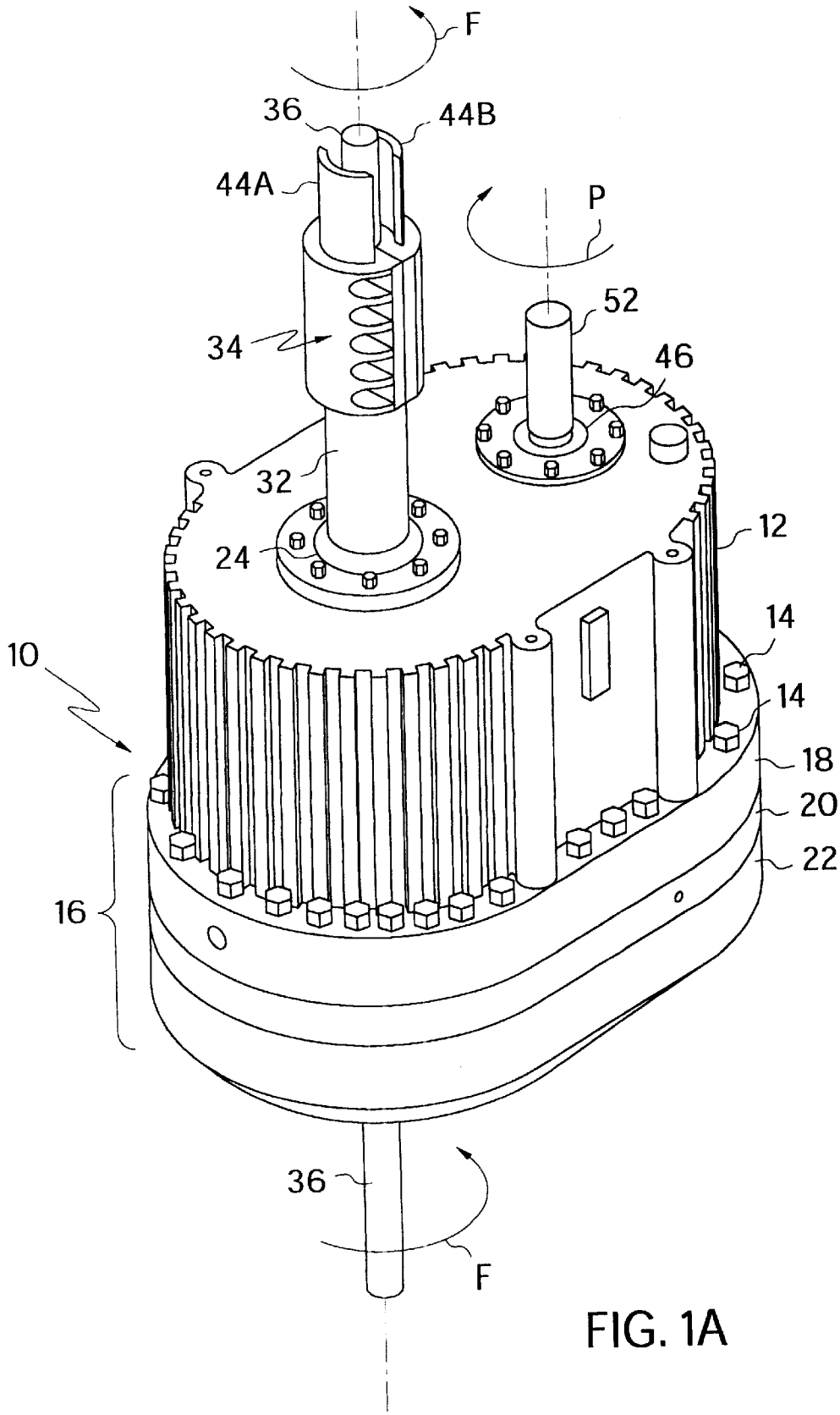
FIG. 1*a* is a perspective view of a preferred embodiment of the pump drive assembly of the present invention.
Figure 1B:
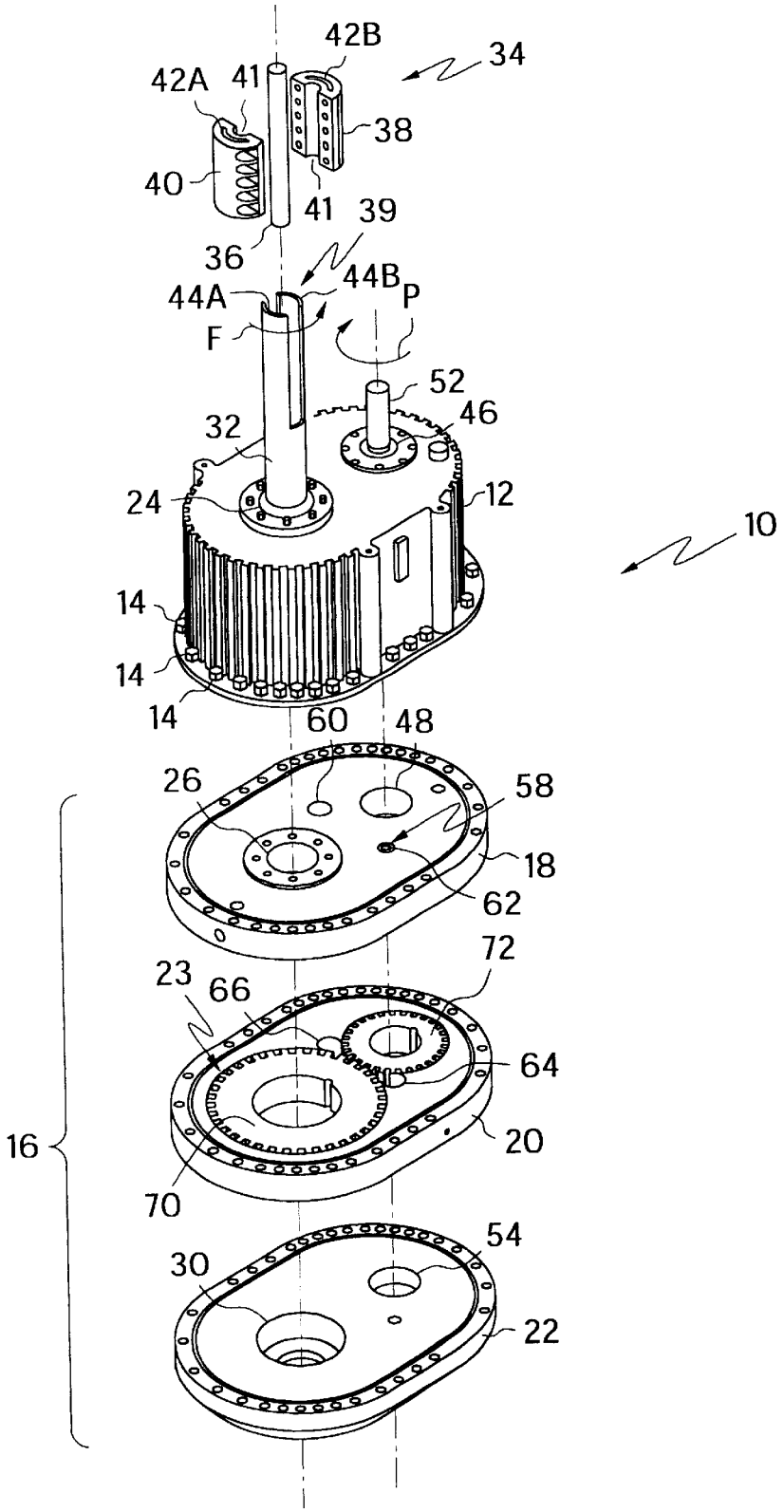
FIG. 1*b* is an exploded, perspective view of the pump drive assembly of FIG. 1*a;*
Figure 2:
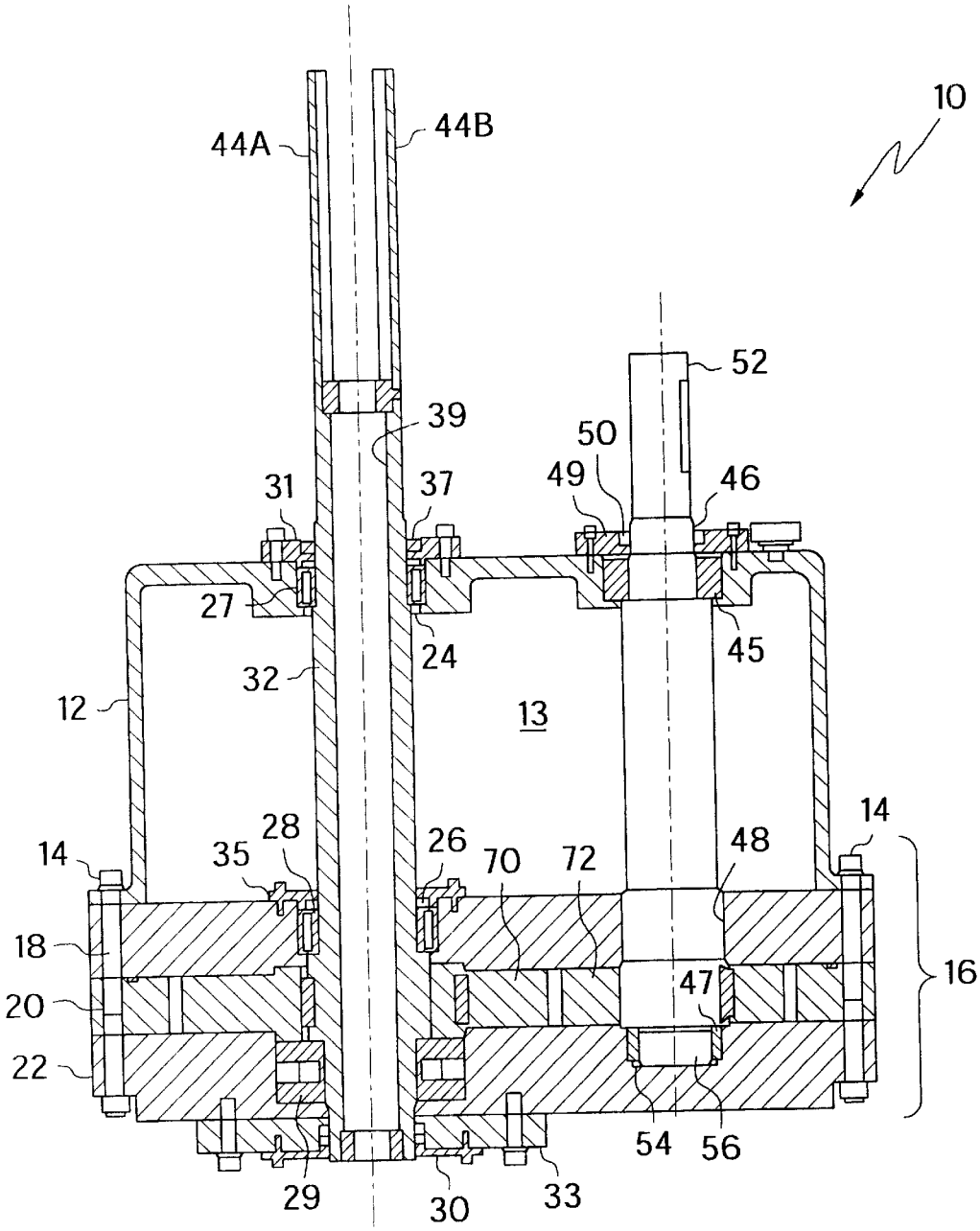
FIG. 2 is a cross-sectional, side elevation view of the pump drive assembly of FIGS. 1*a* and 1*b;*

As shown in FIGS. 1*a*, 1*b* and 2, in accordance with a preferred embodiment of the present invention, a pump drive head assembly, generally designated 10, includes a housing 12, enclosing a hydraulic fluid reservoir 13 therewithin, secured by connecting bolts 14 to a base assembly 16. The base assembly 16 includes an upper drive plate 18, a middle drive plate 20, and a bottom drive plate 22. Each of the upper, middle and bottom drive plates 18, 20, 22 preferably have substantially identical peripheral dimensions so as to provide a substantially smooth outer periphery for the base assembly 16 when the plates are mounted together.

The drive assembly 10 includes a main shaft 32 which extends through apertures 24, 26, and 30 bored through the housing 12, upper drive plate 18 and bottom drive plate 22 respectively. The main shaft 32 includes a main gear 70 keyed to, or otherwise integral with the main shaft 32, where the main gear 70 is maintained within a corresponding lobe 23 of a multi-lobed cavity 25 extending through the middle drive plate 20 (see FIG. 3). The main shaft 32 is journaled by bearings 27 in the aperture 24 extending through the housing 12, is journaled by bearings 28 in the aperture 26 extending through the upper drive plate 18, and is journaled by bearings 29 in the aperture 30 extending through the bottom drive plate 22. An upper flange plate 31 mounted to the housing 12, a lower flange plate 33 mounted to the bottom drive plate 22, and an inner flange 35 mounted to the upper drive plate 18 secure the main shaft 32 within the drive head assembly 10. It will be apparent to those of ordinary skill in the art that appropriate seals 37 are also provided with respect to the main shaft 32. The main shaft 32 includes a cylindrical channel 39 extending axially therethrough for slidably receiving a polished rod 36 coaxially therethrough, where the polished rod is coaxially coupled to a sucker rod 76 of the submersible progressing cavity pump 80 (see FIG. 4). As will be discussed in detail below, the main shaft 32 is slidably, and coaxially coupled to the corresponding polished rod 36 by a polished rod clamp 34.

The drive assembly 10 further includes a drive shaft 52, which extends through apertures 46 and 48 bored through the housing 12 and upper drive plate 18 respectively. The drive shaft 52 is rotatably driven by an external motor 51 (see FIG. 4). The bottom drive plate 22 includes a cylindrical recess 54 shaped to receive a lower extension 56 of the drive shaft 52. The drive shaft 52 includes a drive pinion 72 keyed to, or otherwise integral with the drive shaft 52, where the drive pinion 72 is maintained within a corresponding lobe 53 of the multi-lobed cavity 25 extending through the middle drive plate 20 (see FIG. 3). The drive pinon 72 is engaged with the main gear 70 of the main shaft 32 so that when the motor 51 rotatably drives the drive shaft 52 in a positive direction, indicated by arrow P, the main shaft and polished rod will be counter-rotated in a forward direction, indicated by arrow F.

The drive shaft 52 is journaled by bearings 45 in the aperture 46 extending through the housing 12, and is journaled by bearings 47 within the cylindrical recess 54 extending into the bottom drive plate 22. An upper flange plate 49 mounted to the housing 12 secures the drive shaft 52 within the drive head assembly 10, and appropriate seals 50 are also provided with respect to the drive shaft 52.

Figure 3:
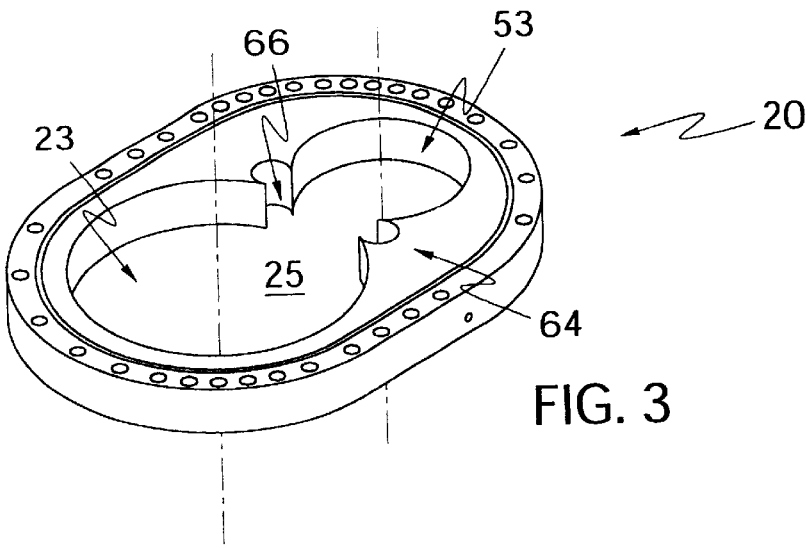
FIG. 3 is a perspective view of a middle drive plate of the pump drive assembly of FIGS. 1*a* and 1*b*.

As shown in FIGS. 1*b* and 3, the upper drive plate 18 includes an inlet channel 58 and an outlet channel 60 providing fluid communication between the fluid reservoir 13 and corresponding inlet and outlet ports 64, 66 of the multi-lobed cavity 25. Accordingly, the positioning of the main gear 70 and drive pinion 72 within the gear chamber formed by the multi-lobed cavity 25 between the upper and bottom drive plates 18, 22 provides a gear pump, internal to the drive head assembly 10. While the embodiment shown in the attached figures depicts a drive head assembly having a hydraulic fluid reservoir located above the drive plates, one of ordinary skill in the art would appreciate that a reservoir below the drive plates is equally feasible and within the scope of the present invention.

The gear pump, when the main shaft is turning in the forward direction F, operates to pump hydraulic fluid from the fluid reservoir 13, downward through the inlet channel 58, into the inlet port 64, around the peripheries of lobes 23 and 53 (driven by the teeth of the main gear 70 and drive pinion 72), into outlet port 66, upward through outlet channel 60, and back into the fluid reservoir 13. Consequently, when the main shaft is turning in a reverse direction, the gear pump will pump the hydraulic fluid in a reverse direction: from the fluid reservoir 13, downward through outlet channel 60, into outlet port 66, around the peripheries of lobes 23 and 53, into inlet port 64, upward through the inlet channel 58, and back into the fluid reservoir 13. This reverse operation of the gear pump will occur during the recoil of the sucker rod and associated polished rod 36 upon motor 51 shut-down or failure.

To control the speed of such recoil, a flow resistor, such as a control valve or a modified check valve 62 is mounted within the inlet channel 58. The modified check valve 62 is designed to allow substantially free flow of the hydraulic fluids downward through the inlet channel 58 when the gear pump is operating in the forward direction, and is designed to substantially, but not completely, retard the flow of the hydraulic fluid upward through the inlet channel 58 when the gear pump is operating in the reverse direction. The modified check valve 62 is preferably of sufficient size such that the flow of the hydraulic fluid is not impeded in a forward direction and large enough to prevent overheating of the fluid when the fluid is traveling in a reverse direction. Accordingly, during recoil of the sucker rod and associated polished rod 36, the retarded flow of hydraulic fluid backward through the inlet channel 58 caused by the modified check valve 62 acts to suitably slow and control the speed of sucker rod recoil. While a modified check valve is used in the embodiment of the present invention herein described, any suitable flow resistors may be used, and it will be apparent to those of ordinary skill that a flow resistor can be inserted into or coupled to either (or both) of the inlet and outlet channels.

Accordingly, it is within the scope of the present invention to provide a pump drive assembly that comprises a housing enclosing a hydraulic fluid reservoir and a gear chamber, a drive shaft assembly including a drive shaft and a drive gear integral with or keyed to the drive shaft positioned in the gear chamber, and a main shaft assembly including a main shaft and a main gear integral with or keyed to the main shaft positioned in the gear chamber and engaged with the drive gear therein; where the gear chamber includes an inlet and an outlet channel providing fluid communication between the chamber and the reservoir, so that the gears form a reversible gear pump within the housing; and where the pump drive assembly also comprises a flow resistor coupled to at least one of the inlet and outlet channels for retarding the flow of the hydraulic fluid when the gear pump is operating in the reverse direction.

To reduce the propensity of the polished rod 36 disengaging from the main shaft 32 resulting from disturbances or bouncing in the polished rod, as shown in FIGS. 1*a* and 1*b*, the present invention also provides a collar such as a polished rod clamp 34, which includes two separate semi-cylindrical components 38, 40 bolted together so as to securely encase a longitudinal portion of the polished rod 36. The clamp components both include a inner arcuate surface 41 that has a diameter matching the diameter of the polished rod 36, and is textured or provided with a coating such as three sixteenth of an inch female acme thread-grooves so as to substantially grip the polished rod. Therefore the clamp components, when encasing the polished rod 36, are substantially fixed with respect to the polished rod. The clamp components 38, 40 each have an arcuate channel 42*a*, 42*b* extending axially therethrough, shaped to receive a corresponding arcuate arm 44*a*, 44*b* extending axially upwardly from the main shaft 32. Preferably, each arm 44*a*, 44*b* is longer than its associated channel 42*a*, 42*b* to provide a wide range of axial movement of the polished rod with respect to the main shaft assembly.

It will be apparent to those of ordinary skill in the art that it is not necessary that the channels 42*a*, 42*b* extend entirely through the polished rod clamp components; however it is desirable that the arms 44*a*, 44*b* extend sufficiently into the clamp 34 to allow some vertical movement of the polished rod 36 with respect to the main shaft, without becoming disengaged from the main shaft 32. It should also be apparent to those of ordinary skill that the channels 42*a*, 42*b* and arms 44*a*, 44*b* need not be arcuate as in the preferred embodiment.

Additionally, it will be apparent to those of ordinary skill in the art that it is within the scope of the invention that the clamp components (as opposed to the main shaft) include downwardly extending arms, slidably received by axially extending channels in the main shaft. It will also be apparent to those of ordinary skill, that the clamp 34 need not be composed of two semi-cylindrical components. The clamp may be integral with the polished rod, or may consist of more than two components. Accordingly, it is within the scope of the invention to provide a coupling assembly for coaxially coupling the polished rod 36 to the main shaft 32 that comprises a plurality of axially extending arms extending from one of the polished rod and the main shaft, and a collar extending radially from the other one of the polished rod and the main shaft, where the collar includes a corresponding plurality of axially extending channels slidably receiving the axially extending arms.

It is also within the scope of the invention to provide a coupling assembly for coaxially coupling the polished rod 36 to the main shaft 32 that comprises at least two coupling components capable of being joined together to securely encase a longitudinal portion of the polished rod 36, where the coupling components collectively contain at least two channels extending axially therethrough so as to receive corresponding arms extending axially from the main shaft 32.

Figure 4:
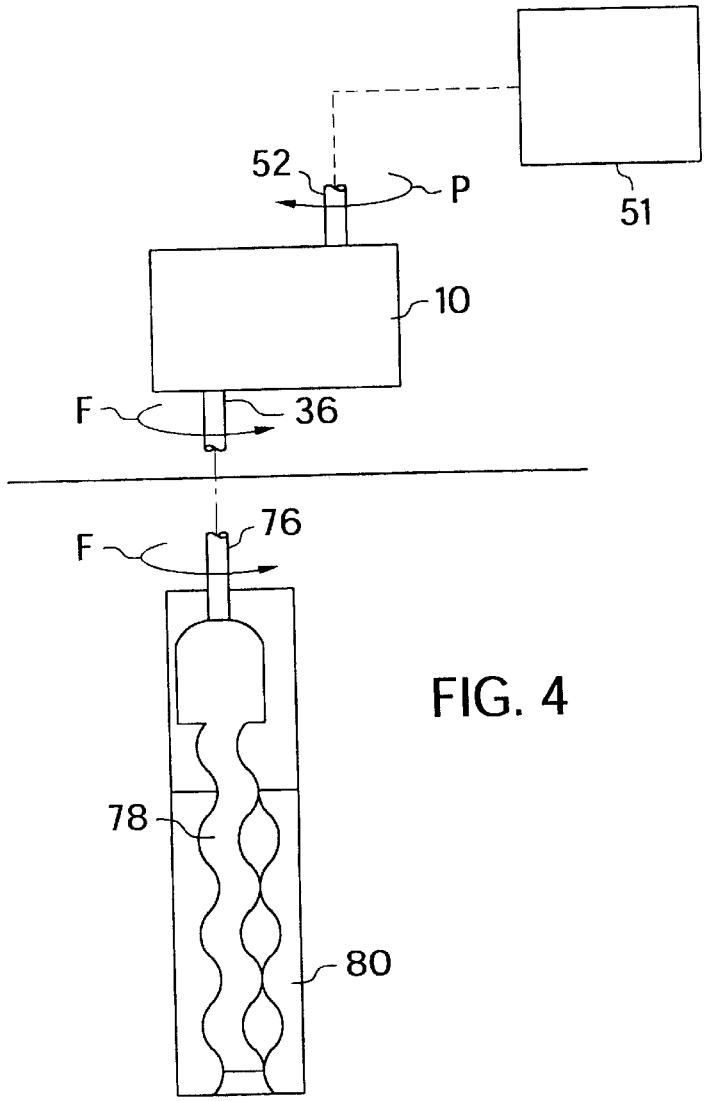
FIG. 4 is a block-diagram representation of a deep well, progressing cavity pump system incorporating the present invention.

As shown in FIG. 4, the drive shaft 52 of the drive assembly 10 is coupled to the motor 51 such that the motor rotatably drives the drive shaft in a positive direction P. This positive rotation of the drive shaft 52, as discussed above, causes a forward rotation F of the polished rod 36, and associated sucker rod 76 and rotor 78 of a deep well, progressing cavity pump 80.

While the form of the apparatus herein described constitutes a preferred embodiment of this invention, it is to be understood that the present invention is not limited to this precise form of apparatus and that changes may be made therein without departing from the scope of the invention.

What is claimed is:

1. A pump drive assembly for a deep well progressing cavity pump, comprising:

a housing enclosing a hydraulic fluid reservoir and a gear chamber separate from said reservoir;

a drive shaft assembly including a drive shaft and a drive gear extending radially from said drive shaft;

a main shaft assembly including a main shaft and a main gear extending radially from said main shaft, said main gear being engaged with said drive gear within said gear chamber, said gear chamber including an inlet channel and an outlet channel providing fluid communication between said gear chamber and said reservoir, said gears forming a reversible gear pump for pumping hydraulic fluid from said reservoir into said chamber and back into said reservoir, said reversible pump operating in a forward direction when said main shaft is rotating in a forward direction and operating in a reverse direction when said main shaft is rotating in a reverse direction; and a flow resistor retarding the flow of said hydraulic fluid at least when said pump is operating in said reverse direction.

2. The pump drive assembly of claim 1, wherein said flow resistor is coupled to one of said inlet and outlet channels.

3. The pump drive assembly of claim 2, wherein said flow resistor permits substantially greater flow of said hydraulic fluid therethrough when said pump is operating in said forward direction as opposed to when said pump is operating in said reverse direction.

4. The pump drive assembly of claim 3, wherein said flow resistor is a modified check valve.

5. The pump drive assembly of claim 1, wherein each of said main and drive gears are respectively seated within separate lobes of a multi-lobed cavity extending within a drive plate, and said pump drive assembly further comprises a flow plate mounted to said drive plate over said cavity so as to form said gear chamber within said cavity, said flow plate including said inlet and outlet channels.

6. A deep-well pump drive assembly comprising:

a housing enclosing a hydraulic fluid reservoir and a gear chamber, separate from said reservoir;

a drive shaft extending into said housing, said drive shaft including a pinion extending radially therefrom; and a main shaft extending into said housing, said main shaft including a gear extending radially therefrom, said main shaft being coaxially coupled to a polished rod of a deep well progressing cavity pump;

said pinion and said gear being engaged with each other within said gear chamber such that positive rotation of said drive shaft causes forward rotation of said main shaft and said corresponding polished rod;

said gear chamber being in fluid communication with said reservoir so as to provide a hydraulic gear pump within said housing, said hydraulic gear pump permitting relatively free rotation of said main shaft and polished rod in a forward direction, and impeded rotation of said main shaft and polished rod in a reverse direction.

7. The pump drive assembly of claim 6, further comprising:

an inlet channel extending between said chamber and said reservoir;

an outlet channel extending between said chamber and said reservoir; and a flow restrictor coupled to at least one of said inlet channel and said outlet channel.

8. The pump drive assembly of claim 7 further comprising:

an upper drive plate mounted within said housing having an upper surface facing said reservoir and a lower surface; and a middle drive plate being attached to said lower surface of said upper drive plate and including a substantially dual-lobed cavity for receiving said pinion and said gear;

said dual-lobed cavity defining said gear chamber;

said upper drive plate including said inlet and outlet channels.

9. The pump drive assembly of claim 8, wherein said flow resistor is a modified check valve mounted within one of said inlet and outlet channels.

10. The pump drive assembly of claim 6, wherein said polished rod is slidably coupled to said main shaft.

11. The pump drive assembly of claim 10, wherein:

one of said main shaft and said polished rod includes a plurality of axially extending arms; and the other one of said main shaft and said polished rod includes a collar extending radially therefrom, said collar including corresponding plurality of axially extending channels slidably receiving said axially extending arms.

12. A drive shaft assembly which drives a polished rod of a deep well progressing cavity pump, comprising:

a main shaft of said drive assembly;

said polished rod of said deep well progressing cavity pump, positioned coaxially with said main shaft; and a coupling assembly, coaxially coupling said polished rod to said main shaft, said coupling assembly including, a plurality of axially extending arms extending from one of said polished rod and said main shaft; and a collar extending radially from another of said polished rod and said main shaft, said collar including corresponding plurality of axially extending channels receiving said axially extending arms, said arms being axially slidable within said channels, thereby providing some axial freedom of movement between said polished rod and said main shaft.

13. The driveshaft assembly of claim 12, wherein said collar extends radially from said polished rod, and said axially extending arms extend upwardly from said main shaft.

14. The driveshaft assembly of claim 13, wherein said collar includes:

a pair of semi-cylindrical components attached to one another to encase a longitudinal portion of said polished rod, each of said semi-cylindrical components including one of said axially extending channels extending therethrough.

15. The driveshaft assembly of claim 14, wherein said axially extending channels and said corresponding axially extending arms are substantially arcuate.

16. The driveshaft assembly of claim 14, wherein said semi-cylindrical components include a textured inner diameter so as to provide a gripping surface abutting said polished rod.

17. The driveshaft assembly of claim 13, wherein said axially extending arms are longer than said axially extending channels.

18. A coupling assembly which coaxially couples a polished rod of a deep well progressing cavity pump to a main shaft of a drive assembly, comprising:

at least two coupling components capable of joining together to securely encase a longitudinal portion of said polished rod, said coupling components collectively containing at least two channels extending axially therethrough so as to receive corresponding arms extending axially from said main shaft, said arms being longitudinally slidable within said channels, thereby providing some longitudinal freedom of movement between said polished rod and said main shaft.

19. A pump drive assembly for a deep well progressing cavity pump, comprising:

a housing enclosing a gear chamber;

a drive shaft assembly including a drive shaft and a drive gear extending radially from said drive shaft;

a main shaft assembly including a main shaft and a main gear extending radially from said main shaft, said main gear being engaged with said drive gear within said gear chamber, said gear chamber including a fluid inlet channel and a fluid outlet channel, said gears forming a reversible gear pump in said housing for pumping fluid along a fluid path, said fluid path including said fluid inlet and outlet channels, said reversible pump operating in a forward direction when said main shaft is rotating in a forward direction and operating in a reverse direction when said main shaft is rotating in a reverse direction; and a flow resistor positioned in said fluid path, permitting substantially greater flow of fluid therethrough when said pump is operating in said forward direction as opposed to when said pump is operating in said reverse direction.

20. The pump drive assembly of claim 19, wherein said flow resister is mounted within one of said fluid inlet and outlet channels.

* * * * *